US010551157B1

(12) United States Patent
Gargrave

(10) Patent No.: US 10,551,157 B1
(45) Date of Patent: Feb. 4, 2020

(54) PORTABLE GUN MAGAZINE HOLSTER SYSTEM AND METHOD OF USE

(71) Applicant: Dale Gargrave, Friendswood, TX (US)

(72) Inventor: Dale Gargrave, Friendswood, TX (US)

( * ) Notice: Subject to any disclaimer, the term of this patent is extended or adjusted under 35 U.S.C. 154(b) by 0 days.

(21) Appl. No.: 15/726,948

(22) Filed: Oct. 6, 2017

Related U.S. Application Data

(60) Provisional application No. 62/405,651, filed on Oct. 7, 2016.

(51) Int. Cl.
*F41A 9/83* (2006.01)
*F42B 39/02* (2006.01)
*A45F 5/02* (2006.01)

(52) U.S. Cl.
CPC ..... *F42B 39/02* (2013.01); *A45F 5/021* (2013.01)

(58) Field of Classification Search
CPC ..... A45F 2200/0591; Y10S 224/931; F41A 9/83; F41A 9/01; F42B 39/02
USPC ..... 224/196, 931
See application file for complete search history.

(56) References Cited

U.S. PATENT DOCUMENTS 5,522,530 A * 6/1996 Boettcher ..... B60R 9/06 224/282
6,050,464 A * 4/2000 Ramsey, Sr. ..... F41A 9/61 206/3
9,933,218 B2 * 4/2018 Butler ..... F42B 39/26

* cited by examiner

*Primary Examiner* — Adam J Waggenspack
(74) *Attorney, Agent, or Firm* — Richard Eldredge

(57) ABSTRACT

A gun magazine holster system includes an upper section with a first wall, a second sidewall, and a third sidewall, the first wall, the second wall and the third wall forming a cavity and an opening; a locking device secured to the second sidewall, the locking device includes a housing; and a spring-loaded bolt; a hinge secured to the first wall; and a clip extending from an outer surface of the first wall; a lower section includes a bottom surface, a first bottom sidewall, and a second bottom sidewall; a bracket rigidly attached to and extending from the second bottom sidewall, the bracket having a hole extending through a thickness of the bracket and configured to engage with the spring-loaded bolt; and a quick-release device secured to the bottom surface, the quick-release device is configured to removably engage with a bottom surface of a gun magazine.

1 Claim, 7 Drawing Sheets

PORTABLE GUN MAGAZINE HOLSTER SYSTEM AND METHOD OF USE

BACKGROUND

1. Field of the Invention

The present invention relates generally to gun magazine holsters.

2. Description of Related Art

Gun holsters and gun magazines are well known in the art. In one embodiment, it is common for a user 101 to secure the magazine 103 directly to the belt 105, and then retrieve the magazine for use, as depicted in FIG. 1. Although effective in most applications of use, it should be understood that significant problems exist when utilizing the embodiment depicted in FIG. 1. For example, the magazine is not readily available for rapid deployment with a single hand.

Great strides in the area of gun holsters and magazines have been made; however, many shortcomings remain. There is a need for a portable gun magazine holster that provides easy and rapid loading of the magazine.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
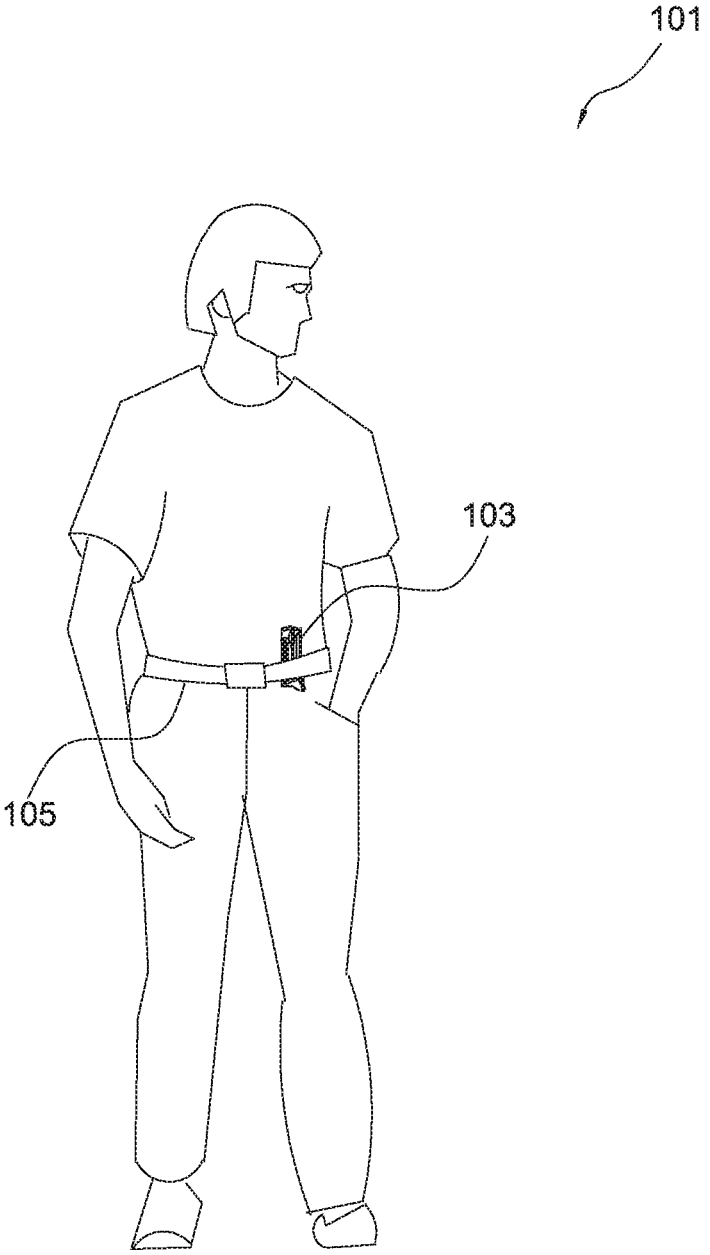
FIG. 1 (PRIOR ART)
FIG. 1 is a simplified schematic of a conventional method to carry a gun magazine.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-5 depict various embodiments of a gun magazine holster system 201 configured to overcome the problems commonly associated with conventional magazine holsters and methods of carrying gun magazines. It should be understood that the embodiments discussed herein are substantially similar in form and function and share one or more of the features discussed in each embodiment although the features may not be shown specifically with reference to the particular embodiment.

Figure 2:
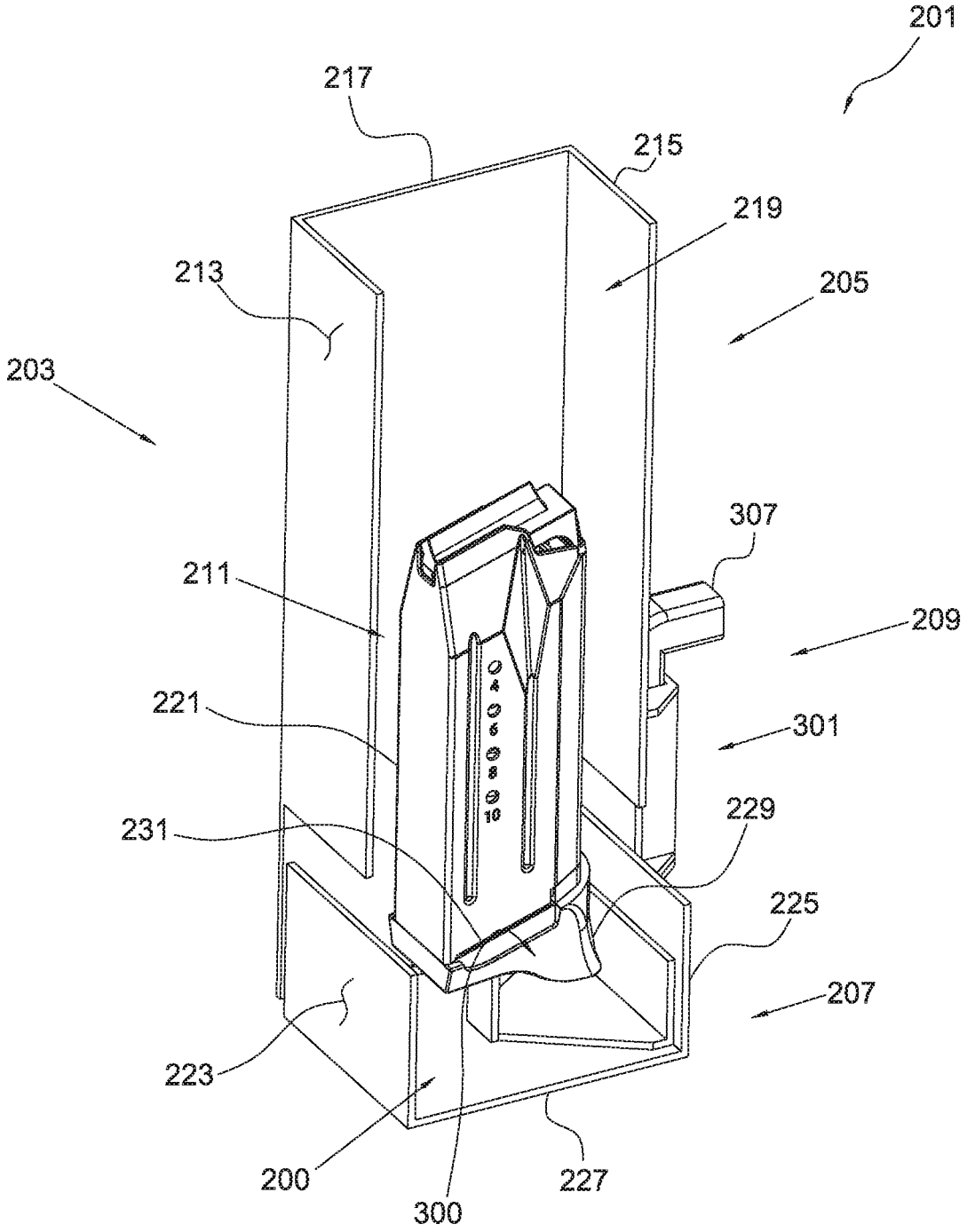
FIGS. 2 and 3 are oblique views of a magazine holster system and method of use in accordance with a preferred embodiment of the present application.
Figure 3:
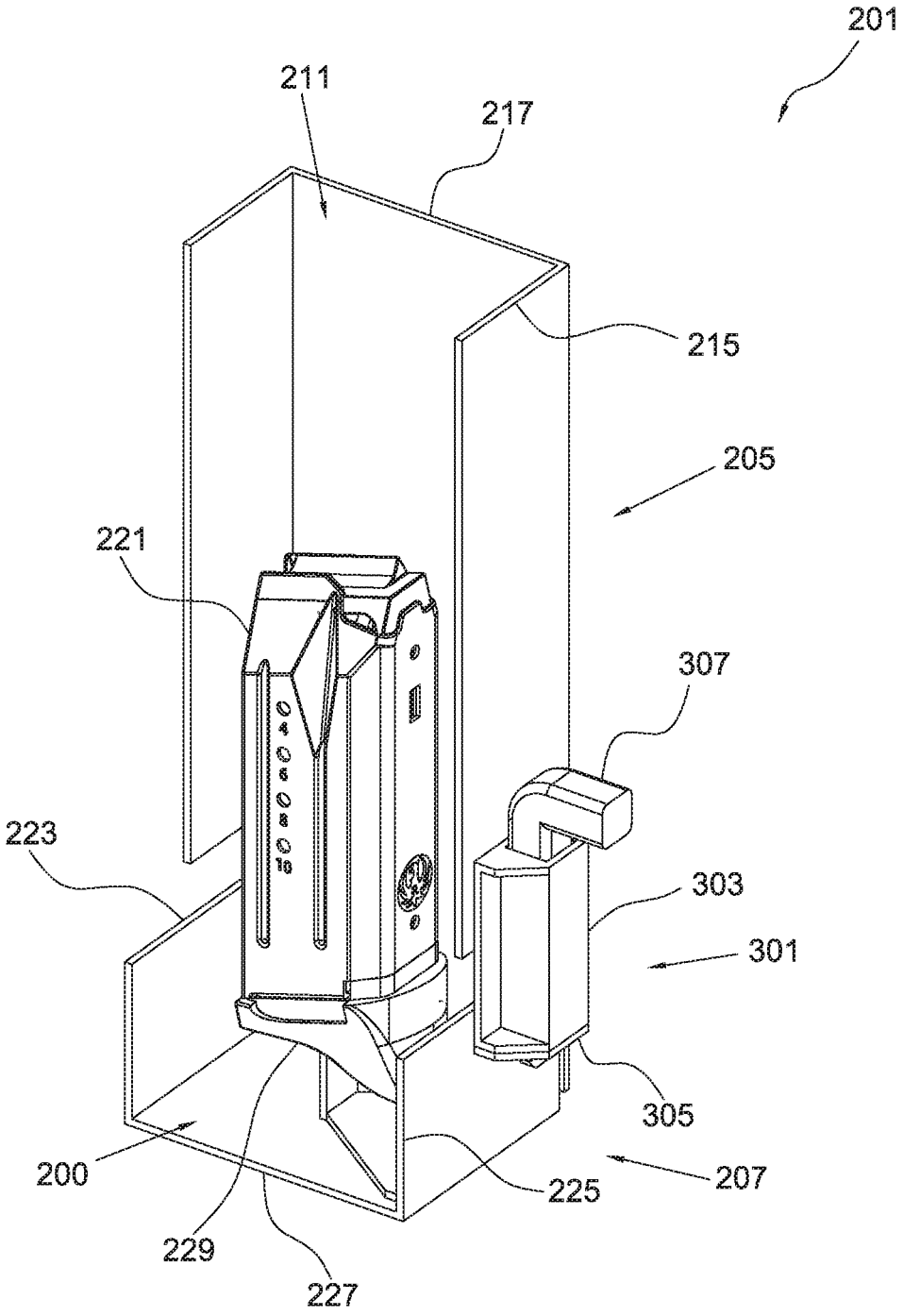

Referring specifically to FIGS. 2 and 3, oblique views of a gun magazine holster system 201 is shown in accordance with one embodiment of the present invention. System 201 preferably includes one or more of a magazine frame 203 having an upper section 205 pivotally attached to a lower section 207 about a pivot joint 401 (see FIG. 4A). The lower section 207 is secured to the upper section 205 via a locking device 209 positioned on a side surface of both the upper and lower sections. During use, the upper section 205 and lower section 207 provide means to secure and house a gun magazine 211 within cavities 219, 200 formed by respective upper section 205 and lower section 207.

The upper section 205 preferably includes two opposing side walls 213, 215 integrally joined to a back wall 217. The three walls form the cavity 219 for housing an upper portion 221 of the magazine 211 therein. Likewise, the lower portion 207 includes two side walls 223, 225 integrally joined to a bottom wall 227. The three walls form the cavity 200 for housing a lower portion and a butt end 231 of the gun magazine 211. Also, the cavity 200 houses a quick-release attachment 229 rigidly attached to side wall 225 and bottom wall 227. The quick-release attachment 229 forms an area 300 peripherally surrounded by walls and adapted to removably engage with the butt end 231.

The locking device 209 preferably includes a housing 301 forming a body 303 rigidly attached to side wall 215 and adapted to slidingly engage with a spring-loaded bolt 307 the slides within an opening (not shown) formed by body 303 and adapted to engage with a bracket 305 rigidly attached to side wall 225. During use, the bolt 307 prevents rotational movement of the lower section 207 relative to the upper section 205 by engaging bracket 305. It will be appreciated that alternative embodiments could include different types of quick-release devices in lieu of the preferred embodiment.

Figure 5:
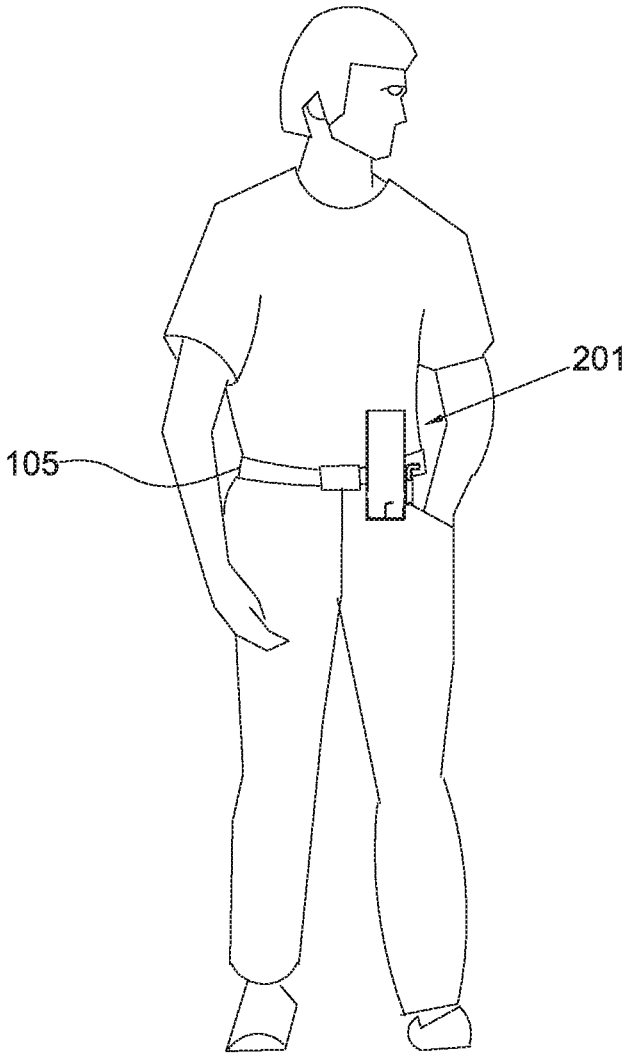
FIG. 5 is a back view of the magazine holster of FIG. 2 secured to a belt of a user.

It will be appreciated that one embodiment could include belt clip 501 having a L-shaped body 503 rigidly attached to and extending from a back surface 505 of the upper section 205. As depicted in FIG. 5, the clip 501 is configured to removably engage with the belt 105 of the user.

Figure 4A:
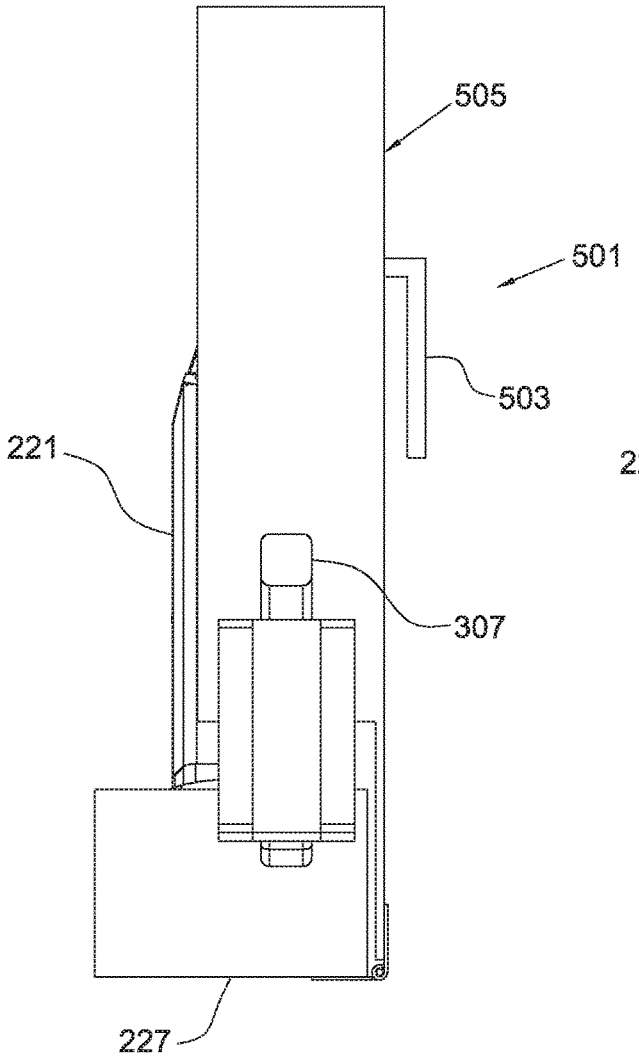
FIGS. 4A, 4B, 4C, and 4D are front and oblique views of the magazine holster of FIG. 2 during use.
Figure 4B:
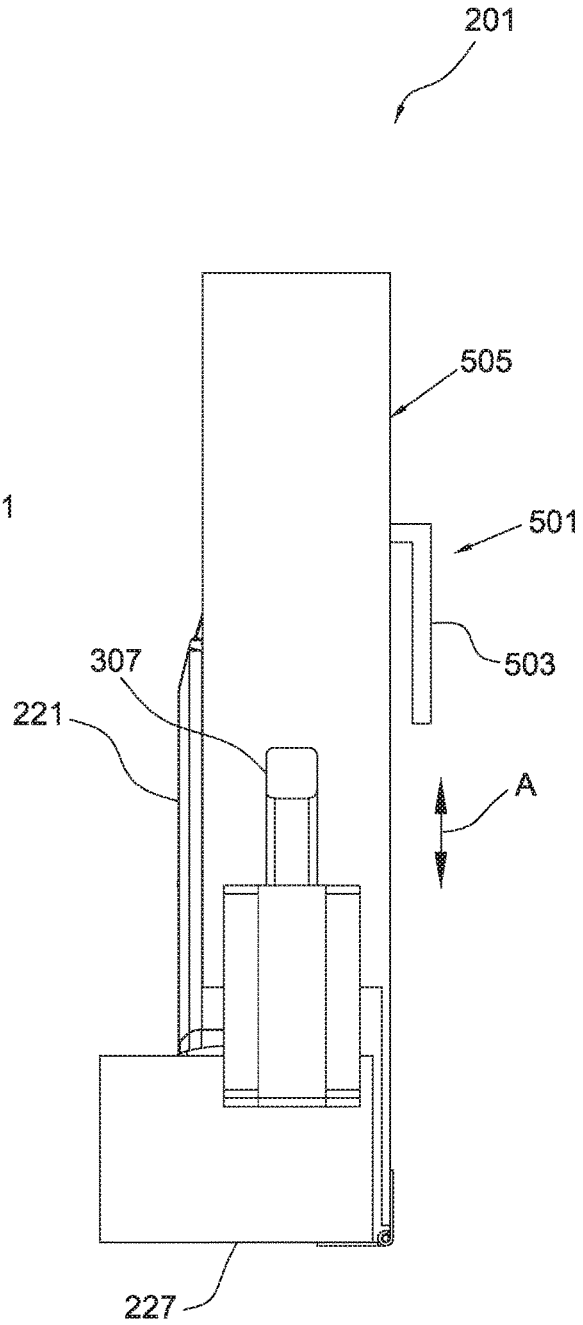
Figure 4C:
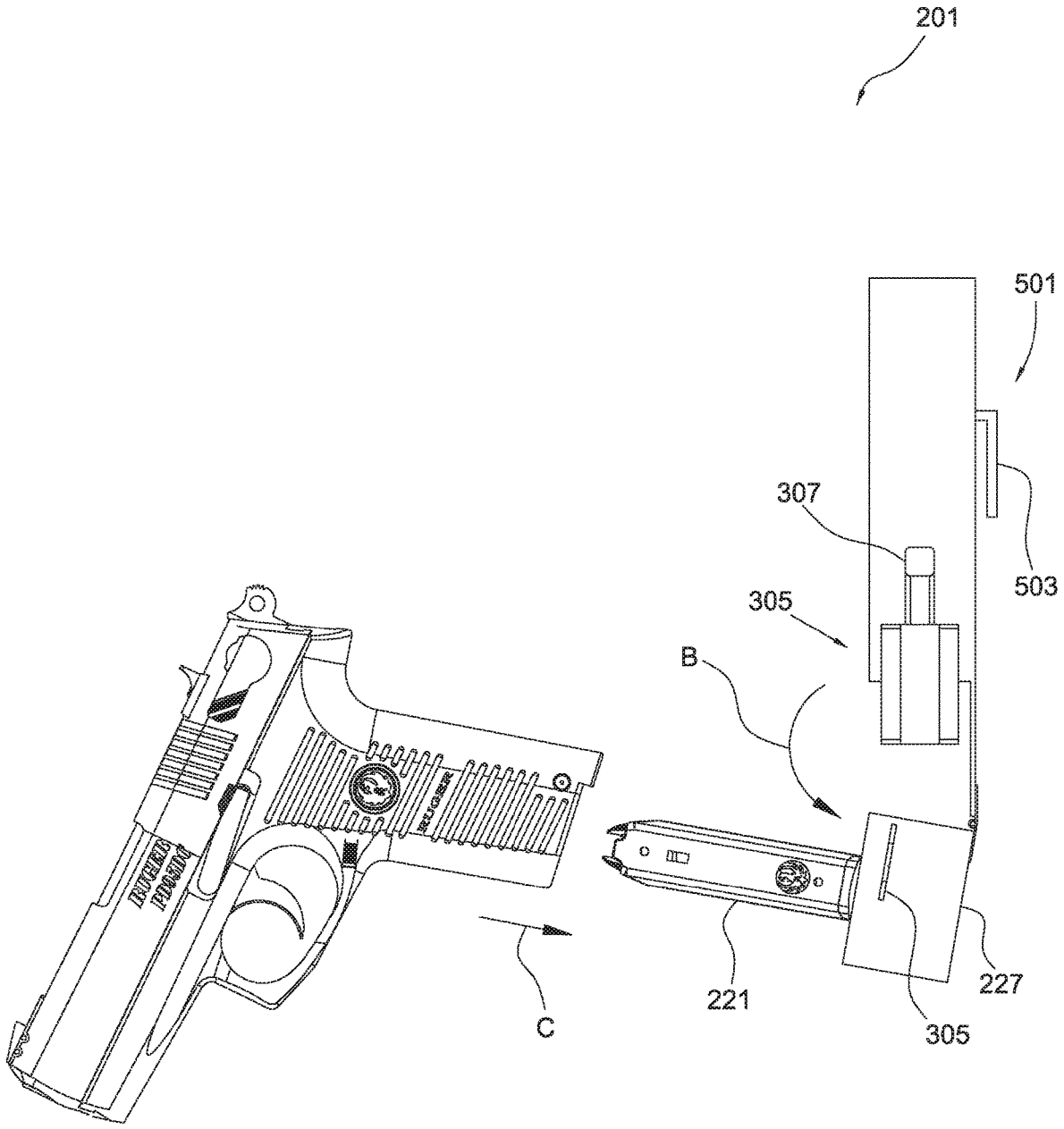
Figure 4D:
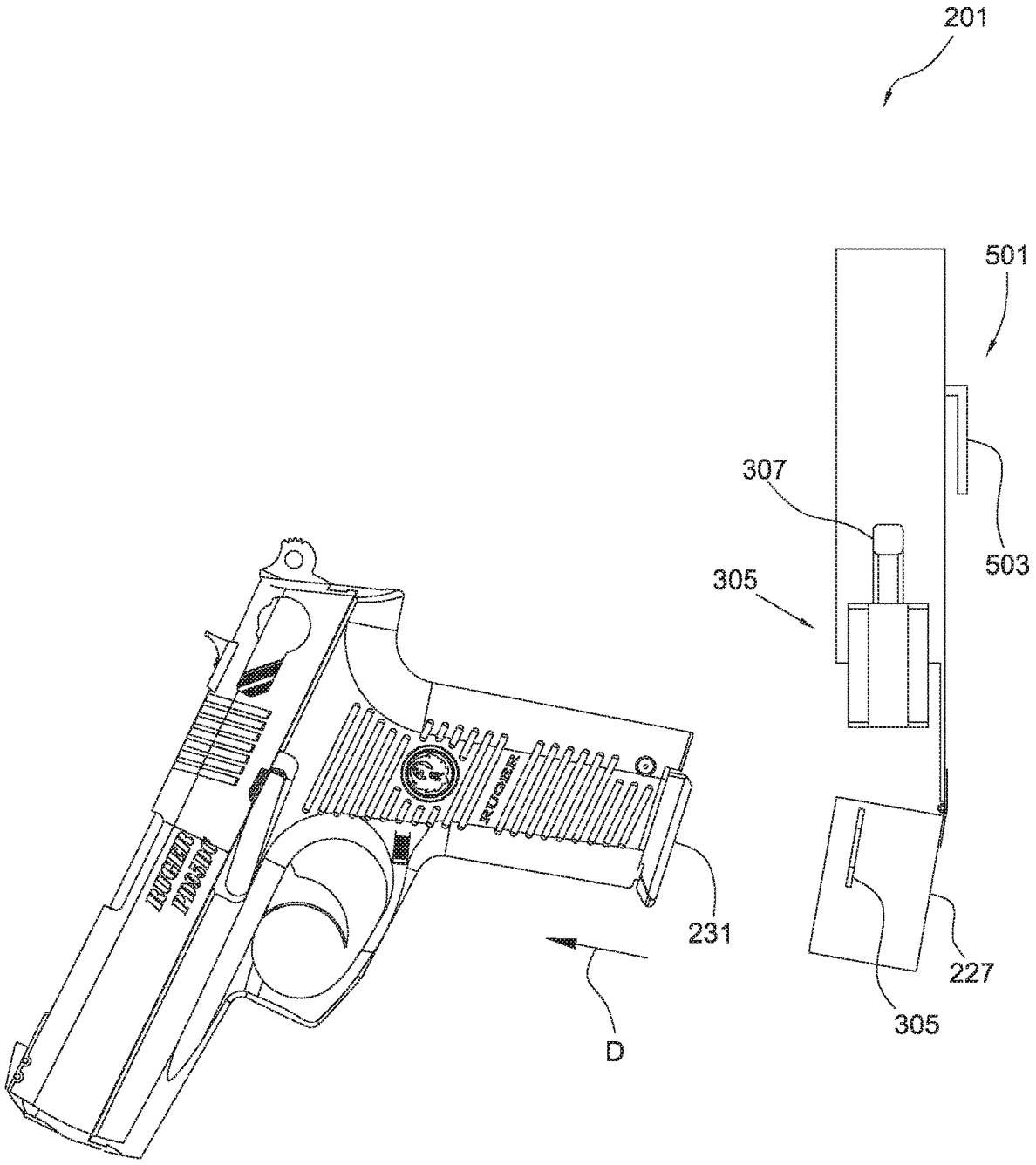

Referring now to FIGS. 4A-4C, the method of use is shown. As depicted in FIG. 4A, the magazine is stored within the cavities created by the upper and lower sections, which in turn are locked together via the locking device 209. In FIG. 4, the bolt of the locking device is moved in direction A, which in turn enables the lower section to disengage from the upper section, as depicted in direction B of FIG. 4C. Thereafter, the magazine is in a position for attachment with the piston, and removed from the quick-release attachment 229 with pressure force thereagainst.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A gun magazine holster system, comprising:

an upper section having:

a first wall, a second sidewall, and a third sidewall, the first wall, the second wall and the third wall forming a cavity and an opening;

a locking device secured to the second sidewall, the locking device having:

a housing; and a spring-loaded bolt;

a hinge secured to the first wall; and a clip extending from an outer surface of the first wall;

a lower section, having:

a bottom surface, a first bottom sidewall, and a second bottom sidewall;

a bracket rigidly attached to and extending from the second bottom sidewall, the bracket having a hole extending through a thickness of the bracket and configured to engage with the spring-loaded bolt; and a quick-release device secured to the bottom surface, the quick-release device is configured to removably engage with a bottom surface of a gun magazine;

wherein the cavity of the upper section is configured to extend around a portion of the gun magazine;

wherein the lower section disengages from the upper section upon activation of the locking device, which in turn causes the lower section to pivot relative to the upper section via the hinge.

* * * * *